US008382097B2

(12) United States Patent
Chiba

(10) Patent No.: US 8,382,097 B2
(45) Date of Patent: Feb. 26, 2013

(54) SHEET FEEDING DEVICE AND IMAGE FORMING APPARATUS

(75) Inventor: Yoshinao Chiba, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/311,327

(22) Filed: Dec. 5, 2011

(65) Prior Publication Data

US 2012/0146282 A1 Jun. 14, 2012

(30) Foreign Application Priority Data

Dec. 8, 2010 (JP) ..... 2010-273897

(51) Int. Cl.
*B65H 1/18* (2006.01)

(52) U.S. Cl. ..... 271/147; 271/160

(58) Field of Classification Search ..... 271/147, 271/152–155, 160

See application file for complete search history.

(56) References Cited

FOREIGN PATENT DOCUMENTS

| | | | |
|---|---|---|---|
| JP | 6-87540 | A | 3/1994 |
| JP | 9-194050 | A | 7/1997 |
| JP | 2006-56685 | A | 3/2006 |

*Primary Examiner* — Michael McCullough

(74) *Attorney, Agent, or Firm* — Canon USA, Inc., IP Division

(57) ABSTRACT

A sheet feeding device may include a tray, a sheet feeder, a pressurizing unit, a height detection unit, a weight detection unit, and a control unit. The tray may be raised and lowered. The sheet feeder sends out a sheet stacked on the tray. The pressurizing unit urges the tray to pressurize the sheet stacked on the tray against the sheet feeder. The control unit adjust pressure force of the pressurizing unit per change in height of sheets stacked on the tray on a basis of weight per unit height of the sheets, calculated on a basis of an initial total weight of the sheets stacked on the tray detected by the weight detection unit before a feeding operation is started and on a basis of the initial height of sheets stacked on the tray detected by the height detection unit before a sheet feeding operation is started.

16 Claims, 7 Drawing Sheets

SHEET FEEDING DEVICE AND IMAGE FORMING APPARATUS

BACKGROUND OF THE INVENTION

1. Field of the Invention

The present invention relates to a sheet feeding device which feeds a sheet from a sheet stack and to an image forming apparatus in which the sheet feeding device is incorporated.

2. Description of the Related Art

A related art image forming apparatus, such as a printer and a copier, is provided with a sheet feeding device which separates stacked sheets one by one and feeds the sheets to an image forming unit. The most common sheet feeding device feeds a sheet in the following manner: a tray carrying a stack of sheets is raised by a pressurizing unit, such as a spring, a sheet is pressed against a paper sheet feed roller, and the paper sheet feed roller is rotated to send the sheet out.

FIG. 8 illustrates an example of a related art sheet feeding device provided with, in a paper cassette 55, a tray 51 which is rotatable about an axis of rotation 56. Sheets S are stacked on the tray 51. The tray 51 is raised by the elastic force of the spring 53 and upper surfaces of the stacked sheets S are pressed against the paper sheet feed roller 54. In this state, the paper sheet feed roller 54 is rotated and the sheets S are sent out sequentially from the topmost sheet.

In order to feed a sheet in a stable manner in such a sheet feeding device, it is necessary to keep paper feeding pressure (i.e., contact pressure between a sheet and a paper sheet feed roller) within an appropriate range as much as possible regardless of sheet size, sheet type (e.g., basic weight) and an amount of stacked sheets. This is because high paper feeding pressure may easily cause multi-page feeding in which two or more sheets are fed at a time and low paper feeding pressure may easily cause defective feeding in which sheets are not successfully fed.

Paper feeding pressure P in the sheet feeding device is expressed by the equation below:

$$P=F-W \tag{1}$$

where F represents pressure force of the pressurizing unit which urges the tray upward and W represents the initial total weight of the sheets stacked on the tray. In a configuration illustrated in FIG. 8, as the sheets are fed, the amount of stacked sheets (height) on the tray 51 is reduced and, as a result, pressure force F and the initial total weight W of the sheets are also reduced. An amount of change ΔP in paper feeding pressure is expressed by the equation below:

$$\Delta P=\Delta F-\Delta W \tag{2}$$

where an amount of change in F is represented by ΔF and an amount of change in W is represented by ΔW. If ΔF and ΔW are equal to each other, it is possible to keep paper feeding pressure to a substantially constant value even if the amount of stacked sheets changes. However, paper feeding pressure usually changes as the number of sheets on the tray decreases depending on sheet size and paper type (basic weight) of the sheets stacked on the tray.

For example, suppose that the same number of DIN A3 sheets and DIN A5 sheets of the same paper type (i.e., of the same thickness) are stacked separately on a tray. The height of stacked sheets is the same in both cases; thus, the length of the spring, i.e., pressure force of the pressurizing unit, is equal in both cases. Paper feeding pressure $P_L$ and $P_S$ are expressed by the equations below:

$$P_L=F-W_L \tag{3}$$

$$P_S=F-W_S \tag{4}$$

where $P_L$ represents paper feeding pressure at the time that sheets of DIN A3 size are stacked, $W_L$ represents the total weight, and $P_S$ represents paper feeding pressure at the time that sheets of DIN A5 size are stacked, and $W_S$ represents the total weight. As known from the equations (3) and (4), a difference ($W_L-W_S$) in the total weight of the sheets produces a difference in paper feeding pressure.

In order to address this problem, a sheet feeding device has been proposed in which pressure force with which a tray is raised is adjusted depending on sheet size and paper type (basic weight), and feeds the sheets. For example, a paper cassette is usually provided with side guide(s) which defines positions of side edges of the sheets stacked thereon. As an alternative, a configuration has been proposed in which pressure force of the pressurizing unit is changed in cooperation with the movement of the side guide which is moved depending on sheet size of the stacked sheets as described in Japanese Patent Laid-Open No. 6-87540.

Japanese Patent Laid-Open No. 2006-56685 proposes a sheet feeding device which changes pressure force by stretching a spring which is a pressurizing unit by a motor depending on sheet size and paper type (basic weight). In this sheet feeding device, pressure force of the pressurizing unit is adjusted by stretching the spring on the basis of an amount of rotation of the motor being selected from a data table stored beforehand in accordance with the input of paper type from a user.

Japanese Patent Laid-Open No. 9-194050 proposes a sheet feeding device in which pressure force is changed by stretching a spring as a pressurizing unit which raises a tray using a motor; in which sheet feeding device, sheet size, paper type and the number of stacked sheets are detected instead of user input. Pressure force of the pressurizing unit is adjusted by stretching the spring by an amount of rotation of the motor corresponding to the detection result of sheet size, paper type and the number of stacked sheets.

However, in the configuration proposed in Japanese Patent Laid-Open No. 6-87540 in which pressure force is changed in cooperation with the movement of the side guide, adjustment can be made regarding only change in sheet size and is not made regarding change in paper type (basic weight) and the number of stacked sheets.

Configurations described in Japanese Patent Laid-Open Nos. 2006-56685 and 9-194050 have the following matters to be addressed. In order to finely adjust pressure force regarding various sheet size, paper type (basic weight), the number of stacked sheets and the like, sheet size, paper type (basic weight) and the number of stacked sheets should be input correctly by a user or should be detected correctly. However, in a currently-used image forming apparatus in which various types of sheets are used, it is significantly difficult to prepare data tables corresponding to each type of the sheets or to automatically detect all the paper types.

That is, a design in which a user inputs the type of sheet to adjust pressure force as described in Japanese Patent Laid-Open No. 2006-56685, it is necessary to correctly input the sheet density and thickness: such an operation is complicated to the user. In addition, determining pressure force correctly and appropriately requires huge amount of data which have been obtained experimentally.

In the configuration described in Japanese Patent Laid-Open No. 9-194050 which automatically detects sheet size, paper type and the number of stacked sheets, a detailed embodiment regarding a method of detecting sheet size and the number of stacked sheets (height) is described; but there is no description about a method of automatically detecting paper type. In other words, correct determination including paper type is not proposed in the configuration described above.

SUMMARY OF THE INVENTION

The present invention provides a sheet feeding device capable of setting appropriate pressure force with high precision depending on sheet size, sheet type (e.g., basic weight) and the amount of stacked sheets.

According to an aspect of the present invention, a sheet feeding device to feed a sheet includes: a tray configured to carry a stack of sheets, including the sheet, and be raised and lowered, a sheet feeder configured to send out the sheet stacked on the tray, a pressurizing unit configured to urge the tray to pressurize the sheet stacked on the tray against the sheet feeder, a height detection unit configured to detect height of sheets stacked on the tray, a weight detection unit configured to detect weight of the stacked sheet, and a control unit configured to adjust pressure force of the pressurizing unit in accordance with change in height of sheets stacked on the tray on a basis of weight per unit height of the sheets calculated in a following manner: weight per unit height of the stacked sheets is calculated on a basis of an initial total weight of the sheets stacked on the tray detected by the weight detection unit before a feeding operation is started and on a basis of the initial height of sheets stacked on the tray detected by the height detection unit before a sheet feeding operation is started.

Further features according to the present invention will become apparent from the following description of exemplary embodiments with reference to the attached drawings.

DESCRIPTION OF THE EMBODIMENTS

Figure 1:
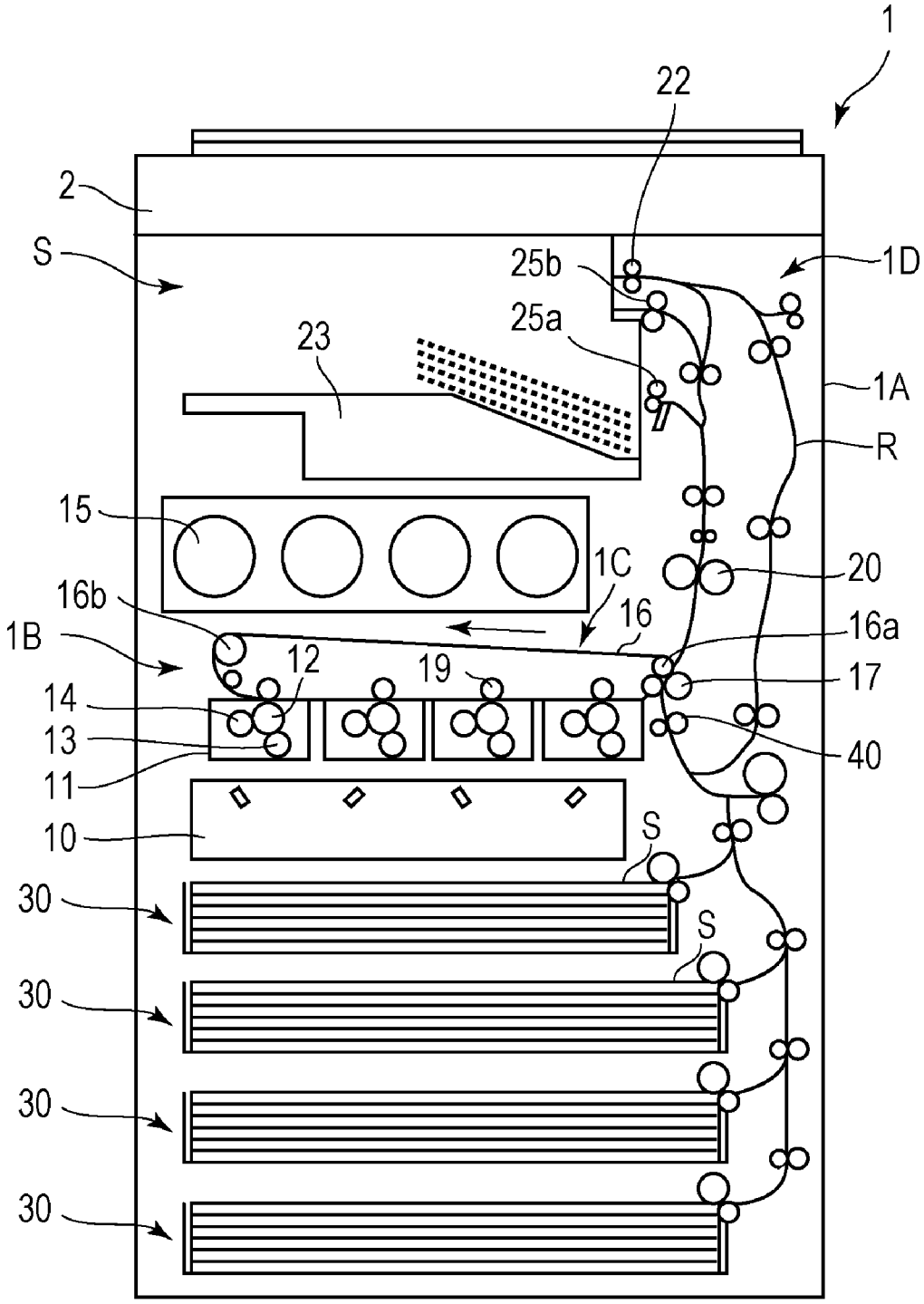
FIG. 1 illustrates an image forming apparatus in which a first embodiment is incorporated.

Hereinafter, an example of a sheet feeding device according to the present invention will described in detail with reference to the drawings. First, the entire configuration of an image forming apparatus in which the sheet feeding device is incorporated will be described schematically. FIG. 1 schematically illustrates a configuration of a full color laser beam printer which is an example of image forming apparatus according to an embodiment.

FIG. 1 illustrates a full color laser beam printer (hereinafter, "printer") 1, a printer main body 1A which is an image forming apparatus body, an image forming unit 1B which forms an image on a sheet and a fixing unit 20. The printer 1 also includes an image reading unit 2 which is an upper device substantially horizontally positioned in an upper portion of the printer main body 1A. A cavity S in which a sheet is discharged is defined between the image reading unit 2 and the printer main body 1A. The printer 1 also includes a toner cartridge 15 and a sheet feeding device 30 which is placed at a lower portion of the printer main body 1A and to which the present embodiment is applied.

An image forming unit 1B is a 4-dram full-color printer provided with a laser scanner 10 and four process cartridges 11 which form a toner image of four colors: yellow (Y), magenta (M), cyan (C) and black (K). Each of the process cartridges 11 is provided with photosensitive drums 12, a charger 13 which is a charging unit, a developer 14 which is a developing unit, and a cleaner (not illustrated) as a cleaning unit. The image forming unit 1B is provided with an intermediate transfer unit 1C positioned above the process cartridge 11.

The intermediate transfer unit 1C is provided with an intermediate transfer belt 16 wound around a driving roller 16*a* and a tension roller 16*b*. The intermediate transfer unit 1C is also provided with a primary transfer roller 19 which is positioned inside the intermediate transfer belt 16 and is in contact with the intermediate transfer belt 16 at a position facing the photosensitive drums 12. The intermediate transfer belt 16, which is formed by a film-shaped member, is in contact with each of the photosensitive drums 12 and rotates in the arrow direction. Each of the color toner images is transferred sequentially on the intermediate transfer belt 16 in a superimposed manner by the primary transfer roller 19 and a color image is formed on the intermediate transfer belt 16. A secondary transfer roller 17 which constitutes a secondary transfer unit is provided at a position facing the driving roller 16*a* of the intermediate transfer unit 1C. The secondary transfer roller 17 transfers the color image formed on the intermediate transfer belt to a sheet S. A fixing unit 20 is placed above the secondary transfer roller 17. A first discharge roller pair 25*a*, a second discharge roller pair 25*b* and a sheet inverter 1D which is a sheet inverting unit are positioned at an upper left side of the fixing unit 20. The sheet inverter 1D includes an inversion roller pair 22 and a re-conveyance path R. The inversion roller pair 22 is a sheet inverting and conveying roller which rotates in forward and backward directions. The re-conveyance path R conveys a sheet which carries an image formed thereon to the image forming unit 1B again.

Next, an image formation operation of the thus-configured printer 1 will be described. Image information read by the image reading unit 2 or image information input from an external device, such as a personal computer (not illustrated), is subject to image processing, converted into electrical signals and then transmitted to the laser scanner 10 of the image forming unit 1B. In the image forming unit 1B, a surface of the photosensitive drum 12 of each process cartridge 11 is scanned by laser light emitted from the laser scanner 10 corresponding to the image information of component colors of yellow, magenta, cyan and black. In this manner, the surface of each photosensitive drum 12, which has been uniformly charged to predetermined polarity and potential, is exposed sequentially by the charger 13. Then, electrostatic latent images of yellow, magenta, cyan and black are formed sequentially on the photosensitive drum of each process cartridge 11.

The electrostatic latent images of yellow, magenta, cyan and black are developed and visualized with toner of each color. The obtained toner images on the respective photosensitive drums are transferred to the intermediate transfer belt 16 sequentially in a superimposed manner with primary transfer bias applied to the primary transfer roller 19. In this manner, a toner image is formed on the intermediate transfer belt 16.

In parallel with the formation of the toner image, the sheet S is sent out from the sheet feeding device 30 illustrated in FIG. 1 and is fed to a resist roller pair 40. The sheet S is conveyed to the secondary transfer unit in a manner that the position of the toner image on the intermediate transfer belt and the position of the sheet S are aligned with each other in the secondary transfer unit which is formed by the driving roller 16A and the secondary transfer roller 17. During the conveyance, oblique travelling of the sheet S is corrected by the resist roller pair 40. Then, in the secondary transfer unit, the toner image is transferred at a time on the sheet S by a secondary transfer bias applied to the secondary transfer roller 17.

Next, the sheet S on which the toner image has been transferred is conveyed to the fixing unit 20, where the toner image is fixed to the sheet S as a color image under heat and pressure in the fixing unit 20. The sheet S on which the image is fixed is discharged to a discharge cavity S by the first discharge roller pair 25*a*, and is stacked onto a stacking portion 23 protruding at a bottom surface of discharge cavity S. In a case in which images are to be formed on both sides of the sheet, the sheet carrying an image on one side thereof is inverted and conveyed to the re-conveyance path R after passing through the fixing unit 20. Then the sheet is conveyed to the resist roller pair 40 again. An image is formed on and fixed to the reverse side. The sheet is discharged to the discharge cavity S by the first discharge roller pair 25*a* and is stacked on the stacked portion S.

First Embodiment

FIGS. 2A to 2E schematically illustrate a configuration of a sheet feeding device according to a first embodiment. As illustrated in FIGS. 2A to 2E, in the sheet feeding device, a tray 51 carrying a stack of sheets S is supported rotatably about an axis of rotation 56 in a box-shaped paper cassette 55 and is capable of being raised and lowered. The tray 51 is provided with a paper sheet feed roller 54 and a separation roller 33. The paper sheet feed roller 54 is a sheet feeding device which catches and feeds the topmost sheet of the sheet stack on the tray 51. The separation roller 33 is pressed against the paper sheet feed roller 54. The sheets are conveyed one by one between the paper sheet feed roller 54 and the separation roller 33. The tray 51 is further provided with a pressure arm 57 which raises or lowers the tray 51 to let a surface of the topmost sheet of the sheet stack on the tray 51 be pressed against the paper sheet feed roller 54. A pressurizing unit which is a feature of the first embodiment is provided with a pressurizer arm 57, a spring 58 and a lift motor 59. The pressurizer arm 57 rotates and is brought into contact with a lower surface of the tray 51. The spring 58 is connected to the pressurizer arm 57. The lift motor 59 stretches the spring 58 which is connected to the pressurizer arm 57. The pressurizing unit drives the lift motor 59 to stretch the spring 58, whereby the pressurizer arm 57 is rotated and is brought into contact with the lower surface of the tray 51. Then the pressurizer arm 57 urges the tray 51 upward.

A rheostat (rotary volume) 61 which detects an amount of rotation of the pressurizer arm 57 is attached coaxial with the axis of rotation 60 of the pressurizer arm 57. An encoder 62 which detects an amount of rotation of the lift motor 59 is attached coaxial with the driving shaft of the lift motor 59. When the pressurizer arm 57 rotates, the rheostat 61 outputs a detection signal in proportion to the amount of rotation of the pressurizer arm 57. The encoder 62 outputs a detection signal in accordance with the amount of rotation of the lift motor 59.

A spring support lever 50 is provided at the axis of rotation 60. The spring 58 is extends between the spring support lever 50 and the encoder 62. The spring support lever 50 rotates in proportion to the amount of rotation of the pressurizer arm 57. The rheostat 61 is provided coaxial with the axis of rotation 60 and the encoder 62 is provided coaxial with the driving shaft of the lift motor 59 in this embodiment. However, such coaxial alignment is not always necessary as long as they fulfill their amount of rotation detection functions. A paper sheet detection sensor 63 which detects the topmost position of the stacked sheets S is provided near a position at which the surface of the topmost sheet S on the tray 51 is in contact with the paper sheet feed roller 54.

When the spring 58 is stretched by the lift motor 59, the pressurizer arm 57 rotates to raise the tray 51; the rotation stops when the surface of the topmost sheet S of the sheet stack on the tray 51 comes in contact with the paper sheet feed roller 54 which is a feeding unit.

Next, a method to appropriately determine a paper feeding pressure value before starting the sheet feeding operation such that neither multi-page feeding nor defective feeding occur in the configuration described above will be described.

Figure 2A:
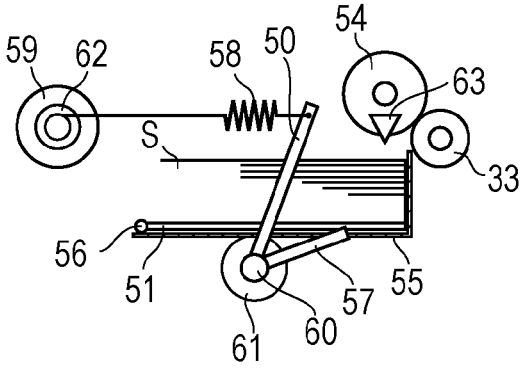
FIGS. 2A to 2E illustrate, in sectional views, operational transition processes of the sheet feeding device according to the first embodiment.

FIG. 2A illustrates a state immediately after a user places the sheet S on the tray 51 of the paper cassette 55 and before the sheet feeding is started. In this state, the pressurizer arm 57 is in contact with the lower surface of the tray 51 and the surface of the topmost sheet S of the sheet stack on the tray 51 is separated from the paper sheet feed roller 54. When the lift motor 59 is rotated from this state, the spring 58 is stretched and the pressurizer arm 57 comes in contact with and applies pressure force to the lower surface of the tray 51. When the lift motor 59 continues rotating, the tray 51 starts rotating after the pressure force balances with weight of the sheet S.

The tray 51 and the pressurizer arm 57 continue rotation until the surface of the topmost sheet S comes in contact with the paper sheet feed roller 54. During this operation, the paper sheet detection sensor 63 detects the topmost position of the sheet S of the sheet stack on the tray 51, and then an output signal is turned ON (which represents that a paper sheet has been detected) from OFF (which represents that no paper sheet has been detected). That is, the paper sheet detection sensor 63 is positioned such that the paper sheet detection sensor 63 outputs an ON signal in a process in which the tray 51 is raised. The paper sheet detection sensor 63 may output the ON signal at any time between start and stop of the rotation of the tray 51.

Figure 2B:
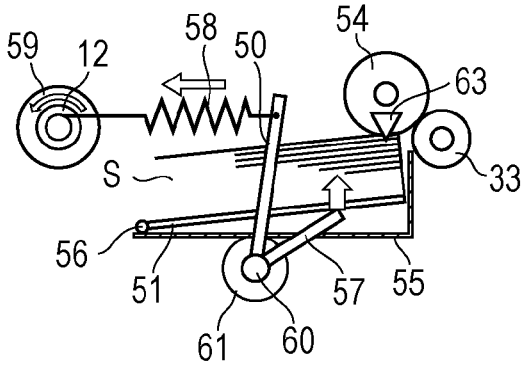

In the first embodiment, the paper sheet detection sensor 63 is positioned such that the ON signal is output immediately before the uppermost surface of the sheet S comes in contact with the paper sheet feed roller 54. FIG. 2B illustrates this state. At this time, paper feeding pressure (i.e., pressure in a state in which the upper surface of the sheet is in contact with the paper sheet feed roller 54) is substantially 0, and the pressure force of the spring 58 balances with the weight of the stacked sheet S. The paper sheet detection sensor 63 constitutes a balanced state detection unit.

Figure 2C:
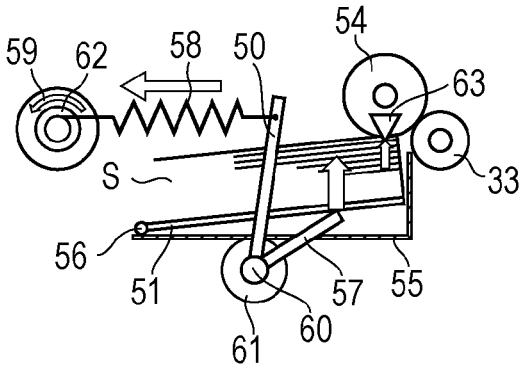

Paper feeding pressure is determined depending on an amount of stretch of the spring 58 from the state of FIG. 2B (FIG. 2C). That is, the pressure force to the tray 51 applied by the pressurizer arm 57 is determined depending on the amount of stretch of the spring 58 after the ON signal is output by the paper sheet detection sensor 63 and the pressure force constitutes the paper feeding pressure; thus it is only necessary to stretch the spring 58 by a predetermined amount sufficient to generate the paper feeding pressure. If the amount of stretch of the spring 58 from the state of FIG. 2B is constant, the paper feeding pressure before starting sheet feeding operation can be made constant regardless of type, size and amount of stacked sheets.

In control performed before the sheet feeding is started, the paper feeding pressure before sheet feeding is started can be made constant; but change in paper feeding pressure due to reduction in the number of stacked sheet S as the sheets are fed is out of control. Here, control to keep the paper feeding pressure constant as the number of stacked sheet S is reduced will be described. In a configuration in which a spring is used as the pressurizing unit as described in the present embodiment, the following equations are satisfied:

$$\Delta F = k\Delta t \tag{5}$$

$$\Delta W = \rho\Delta t \tag{6}$$

where k represents spring constant, Δt represents the height of stacked sheets S which has been reduced during the sheet feeding, ρ represents weight of sheet per unit thickness, ΔF represents an amount of change in pressure force F of the pressurizing unit and ΔW represents an amount of change in weight W of the sheet. Thus, the amount of change ΔP of the paper feeding pressure is obtained by the following equation on the basis of equations (2), (5) and (6).

$$\Delta P = (k - \rho)\Delta t \tag{7}$$

Figure 2D:
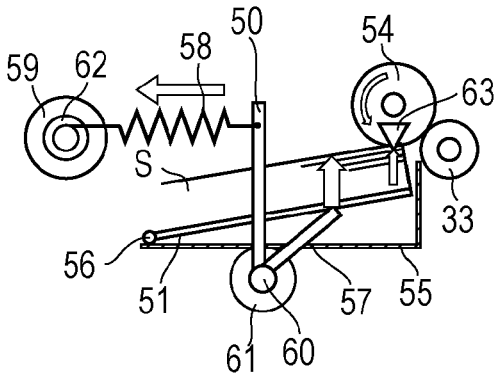
Figure 2E:
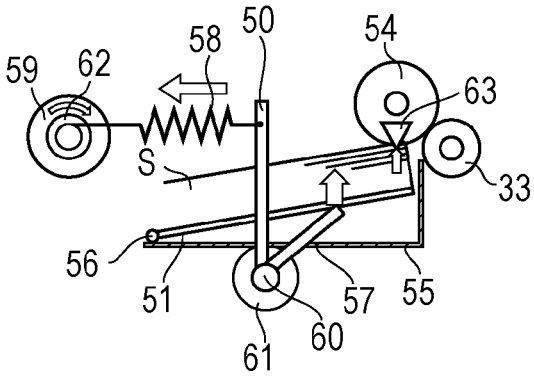
Figure 3:
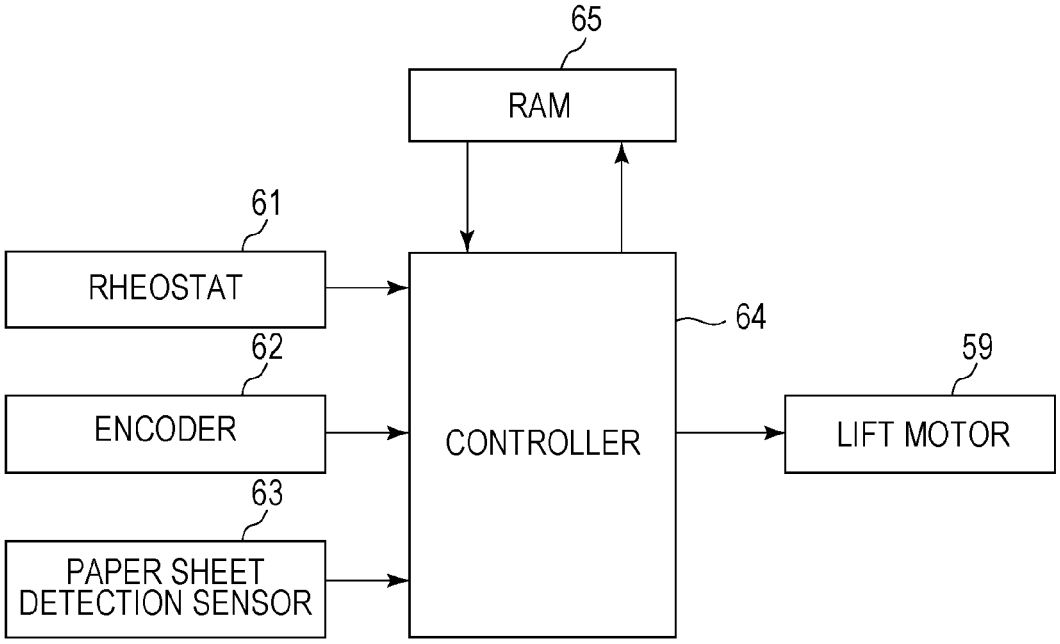
FIG. 3 illustrates, in a control block diagram, a sheet feeding device according to the first embodiment.

Control of reducing the amount of change ΔP of the paper feeding pressure will be described with reference to a control block diagram of FIGS. 2 and 3, and a flowchart of FIG. 4.

First, the control block diagram of FIG. 3 will be described. RAM 65 is connected to a controller (CPU) 64 as memory. A detection signal from the rheostat (rotary volume) 61, a detection signal from the encoder 62 and a detection signal from paper sheet detection sensor 63 are input to the controller 64. The controller 64 and the lift motor 59 are connected to each other such that the controller 64 controls an operation of the lift motor 59 in accordance with each of the detection signals.

Figure 4:
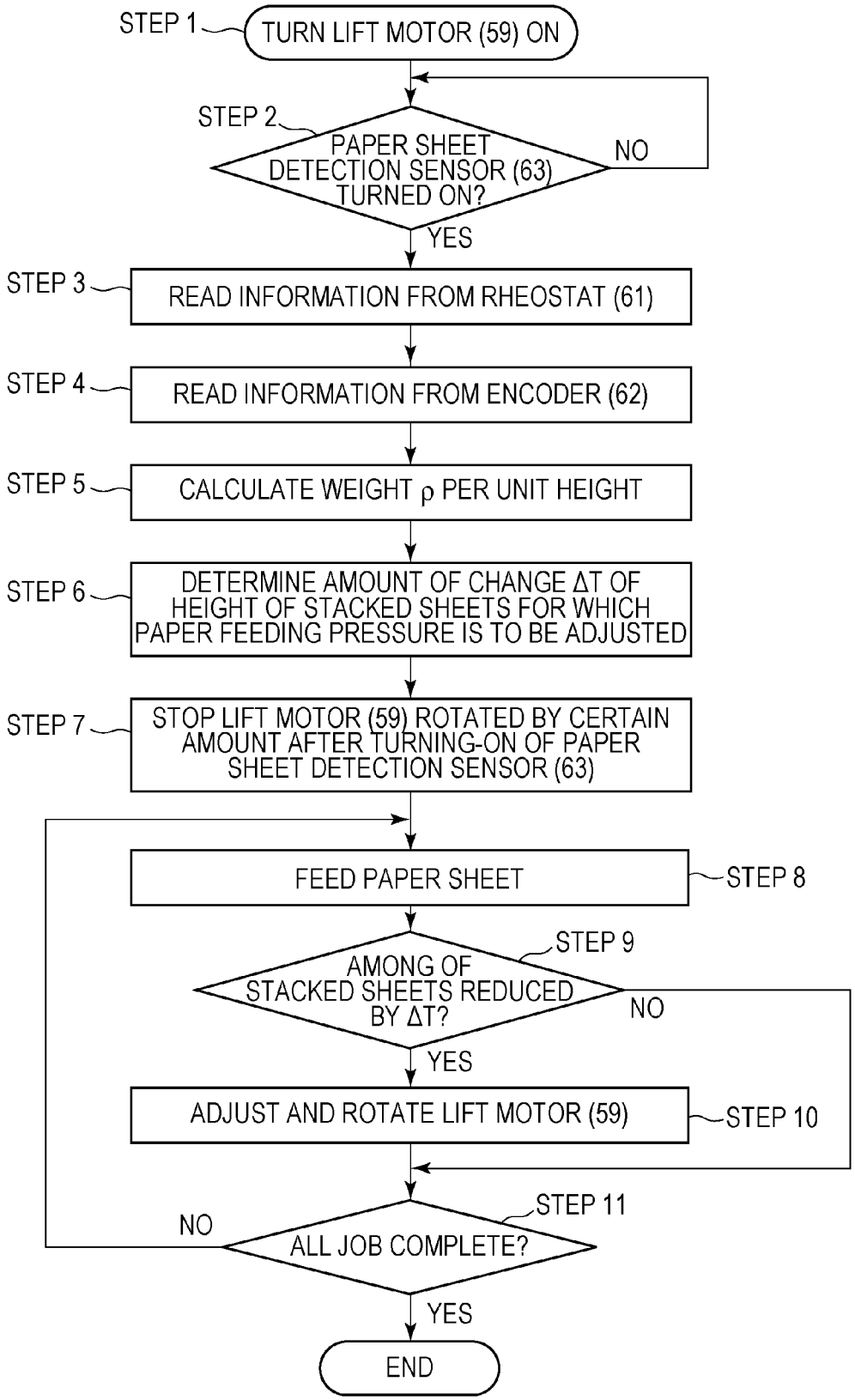
FIG. 4 illustrates, in a flowchart, an operation of the first embodiment.

Next, control in accordance with this control block diagram is described using flowchart illustrated in FIG. 4. In Step 1, the lift motor 59 is operated to rotate the pressurizer arm 57. In Step 2, the lift motor 59 is continued to be driven until the paper sheet detection sensor 63 outputs the ON signal (the state of FIG. 2B). In Step 3, upon the output of the ON signal by the paper sheet detection sensor 63 (Step 2: Yes), the detection signal in accordance with the amount of rotation of the pressurizer arm 57 is sent to the controller 64 from the rheostat 61. In Step 4, a detection signal in accordance with the amount of rotation of the lift motor 59 is sent to the controller 64 from the encoder 62.

The initial height t and the initial total weight W of the sheets stacked on the tray 51 are calculated in accordance with the detection signal from the encoder 62 which constitutes the rotation angle detection unit and the detection signal from the rheostat 61 which constitutes the weight detection unit. In particular, the initial height t of stacked sheets S on the tray 51 is obtained on the basis of the amount of rotation of the pressurizer arm 57 since the lift motor 59 starts rotating to rotate the pressurizer arm 57 until the paper sheet detection sensor 63 outputs the ON signal and the lift motor 59 stops. The initial height t of stacked sheets S can be geometrically calculated on the basis of the distance between the axis of rotation 60 of the pressurizer arm 57 and an end of the pressurizer arm 57 which comes in contact with the lower surface of the tray 51, and on the basis of the rotation angle of the pressurizer arm 57 calculated in accordance with the signal from the rheostat 61. A height detection unit which detects the height of the sheet stacked on the tray 51 is constituted by the rheostat 61, the paper sheet detection sensor 63 and other components.

The initial total weight W of the sheets on the tray 51 is obtained on the basis of the amount of rotation of the lift motor 59. In particular, the initial total weight W of the sheets is calculated on the basis of the amount of stretch of the spring 58 since the lift motor 59 starts rotation until the paper sheet detection sensor 63 outputs the ON signal and the lift motor 59 stops. That is, the elastic force of the spring 58 is calculated in the following manner: a substantial amount of stretch of the spring 58 is geometrically calculated on the basis of the amount of stretch of the spring 58 known from the encoder 62 which constitutes the pressure force detection unit, and then the amount of stretch is multiplied by the spring constant. The initial total weight W of the sheets is obtained on the basis of the elastic force of the spring 58. The weight detection unit is constituted by the encoder 62 and the paper sheet detection sensor 63.

Therefore, the weight ρ per unit height of the sheets stacked on the tray 51 is obtained by the equation below.

$$\rho = W/t \tag{8}$$

The weight ρ per unit height of the sheets is calculated by the controller 64 on the basis of equation (8) (Step 5). Since the amount of change ΔP of the paper feeding pressure when the height of stacked sheets has changed by Δt is expressed by equation (7), the following equations are satisfied where Δx represents an amount of change in length of the spring for cancelling the amount of change ΔP of the paper feeding pressure:

$$(k - \rho)\Delta t = k\Delta x \tag{9}$$

$$\Delta t = k\Delta x/(k - \rho) \tag{10}$$

The spring constant k is determined during the design of the apparatus. The weight ρ per unit height of the sheets stacked on the tray 51 has been obtained by equation (8). Thus, if Δx is determined in advance, the amount of change Δt in height of stacked sheets to be adjusted regarding pressure force can be determined (Step 6). That is, when the height of stacked sheets is reduced by Δt, it is possible by pulling the spring 58 by Δx, to increase pressure force corresponding to the amount of reduction in paper feeding pressure and to return to the paper feeding pressure which has been determined before feeding the sheet. In an actual apparatus, it is not possible to return the paper feeding pressure to the original value due to, for example, operational errors, but change in paper feeding pressure can be reduced. The thus-calculated Δt is stored in the RAM 65.

On the basis of the time at which the paper sheet detection sensor 63 outputs ON signal (FIG. 2B), the lift motor 59 rotates a certain amount and stops when predetermined paper feeding pressure is obtained (Step 7). The certain amount of rotation of motor at this time is determined in advance on the basis of the spring constant and the determined paper feeding pressure. The state at this time is illustrated in FIG. 2C.

Feeding of the sheet is started in a state in which the sheet S is in contact with the paper sheet feed roller 54 under the determined paper feeding pressure (Step 8). The amount of rotation of the pressurizer arm 57 is read each time the sheet is fed, and the sheet is fed without change in the amount of stretch of the spring 58 until the amount of stacked sheets is reduced by Δt (FIG. 2D). It is determined in Step 9 whether the amount of stacked sheets S has been reduced by Δt. If it is determined that the amount of stacked sheets S has been reduced by Δt (Step 9: Yes), the lift motor 59 is driven in Step 10 such that the spring 58 is pulled by the amount Δx determined before feeding of the sheet is started, whereby pressure force is adjusted (FIG. 2E).

Then, the amount of change in the amount of stacked sheets is monitored until all the jobs are completed in Step 11. If the amount of stacked sheets has changed by Δt, pressure force is adjusted by Δx by rotating the lift motor 59 to pull the spring 58. Even if the sheets S are reduced in number, paper feeding pressure can be kept at a substantially constant value (i.e., a range with smaller change) by repeating control of adjustment of pressure force.

Figure 5:
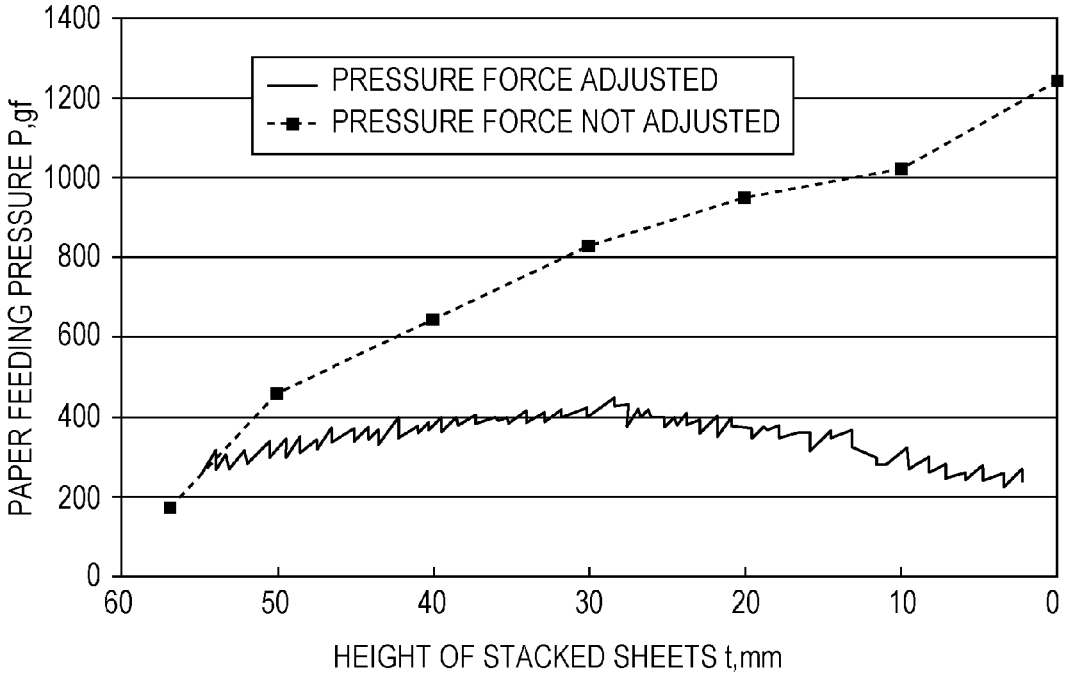
FIG. 5 illustrates an example of relationship between height of stacked sheets and paper feeding pressure of the sheet feeding device according to the first embodiment.

FIG. 5 illustrates change in paper feeding pressure with respect to the height of stacked sheets in a case in which the lift motor 59 is rotated by a certain amount to adjust pressure force when an angle of the pressurizer arm 57 is changed by a certain amount in the configuration of the first embodiment. As a comparison, change in paper feeding pressure in a related art in which pressure force is not adjusted is illustrated by a dashed line. The amount of stacked sheets gradually changes from the full amount (the left side of the horizontal axis) to the reduced amount (the right side of the horizontal axis). If pressure force is not adjusted, a difference in paper feeding pressure of about 1000 gF occurs between the full amount state and a state with no sheet left. In comparison, if pressure force is adjusted as in the first embodiment, change in paper feeding pressure is within a range of about 200 gF.

In the configuration and control of the first embodiment, it is possible to determine paper feeding pressure to be an arbitrary value. If the optimal paper feeding pressure is determined experimentally beforehand for each characteristic of the sheet, the sheet can be fed reliably under the determined paper feeding pressure even in a case in which a user uses a special sheet (which is easily subject to multi-page feeding or defective feeding under normal paper feeding pressure).

Although the paper sheet detection sensor 63 is used as a unit to detect that pressure force and the total weight of the sheets are balanced in the first embodiment, the paper sheet detection sensor 63 may be replaced with the rheostat (volume) 61. In particular, the rheostat 61 detects stop of rotation of the tray 51. Paper feeding pressure is 0 and pressure force and the total weight of the sheets are balanced immediately before rotation of the tray 51 stops, i.e., immediately before the sheet S comes into contact with the paper sheet feed roller 54. As described above, since the state in which spring force and the total weight of the sheet is balanced can be detected by the rheostat 61, the paper sheet detection sensor 63 can be omitted.

Second Embodiment

Figure 6A:
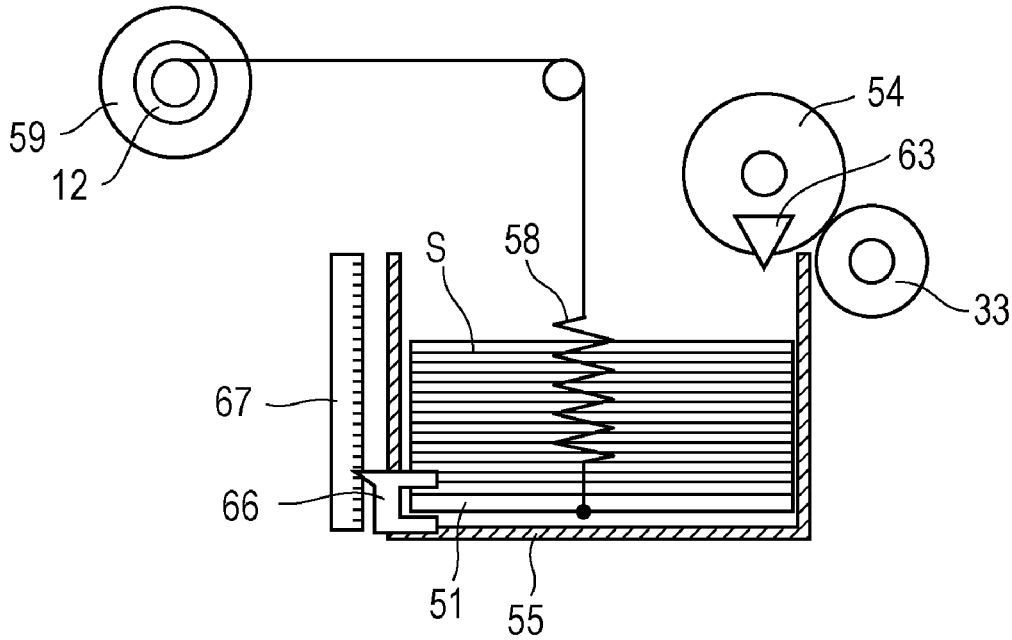
FIGS. 6A and 6B illustrate, in sectional views, an operational transition process of a sheet feeding device according to a second embodiment.

A sheet feeding device according to a second embodiment will be illustrated in FIG. 6A in a schematic sectional view. In the first embodiment, the spring 58 is pulled by the lift motor 59 and thereby the tray 51 is rotated and the sheet S comes in contact with the paper sheet feed roller 54; in the second embodiment, the tray 51 is moved in a vertical direction to bring the sheet S into contact with the paper sheet feed roller 54.

Figure 6B:
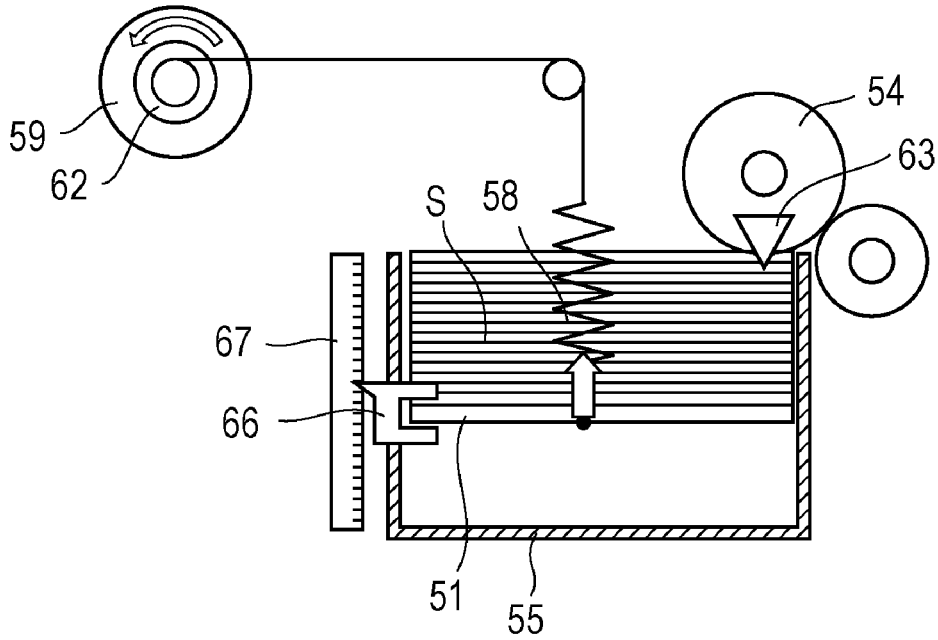

For this purpose, an encoder 62 which reads an amount of rotation of the lift motor 59, and a paper sheet detection sensor 63 which reads a paper sheet S immediately before the sheet S comes in contact with the paper sheet feed roller 54 (FIG. 6B) are provided in the present embodiment similarly to the first embodiment. In contrast to the first embodiment, a lever 66 which moves upward together with the raising of the tray 51 is provided in the tray 51 in place of the pressurizer arm 57 in the present embodiment. In addition, a height of stacked sheets detection sensor 67, such as slide volume, of which output changes with the position of the lever 66, is provided in place of the rheostat (rotary volume).

In the configuration of the present embodiment, paper feeding pressure can be kept substantially constant (in a range in which change is small) with the control the same as that of the first embodiment.

Third Embodiment

Figure 7:
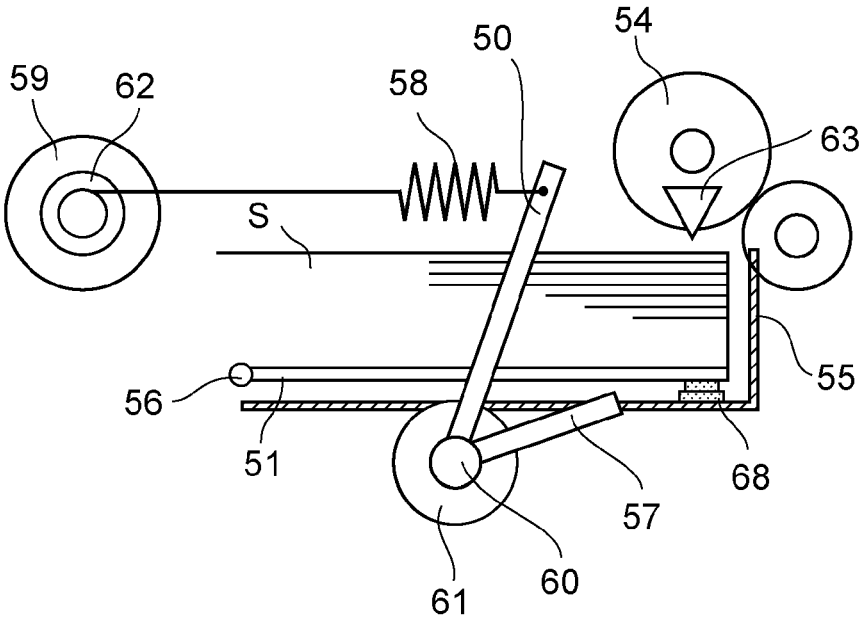
FIG. 7 illustrates, in a sectional view, a sheet feeding device according to a third embodiment.
Figure 8:
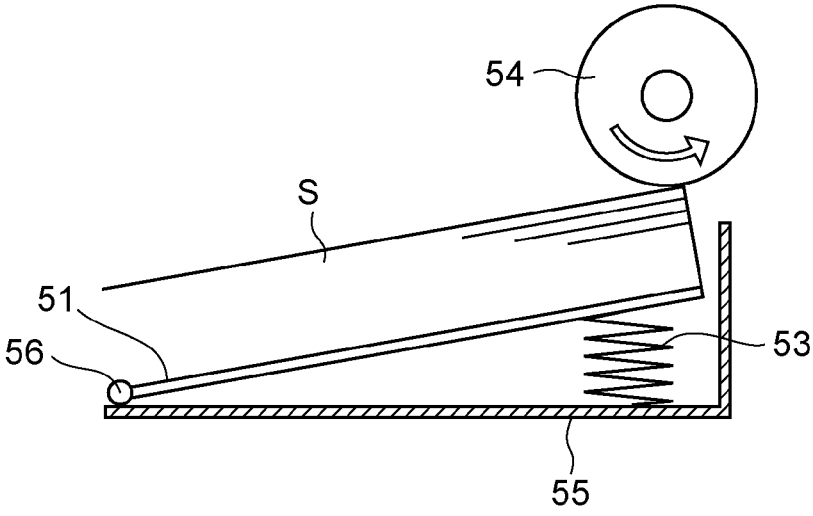
FIG. 8 is an example of configuration for producing paper feeding pressure by raising a tray on which sheets are stacked.

FIG. 7 illustrates, in a schematic sectional view, a sheet feeding device according to a third embodiment. The third embodiment differs from the first embodiment in that a weight detection sensor 68, such as a strain gauge, is attached to the paper cassette 55. In the first embodiment, the initial total weight W of the sheets is calculated by a combination of the rheostat 61, the encoder 62 and the paper sheet detection sensor 63; in the present embodiment, the initial total weight W of the sheets is detected directly. At the time immediately after the user places a sheet, the tray 51 is supported by an axis of rotation 56 and the weight detection sensor 68. That is, the initial total weight W of the sheets can be detected directly on the basis of the output of the weight detection sensor 68 at this time.

Control to keep the paper feeding pressure before sheet feeding is started constant regardless of sheet size, sheet type and the amount of stacked sheets is the same as that of the first embodiment. That is, an amount of stretch of the spring 58 since the time at which the paper sheet detection sensor 63 is turned ON from OFF is kept constant. In addition, control to reduce change in paper feeding pressure at the time that the number of stacked sheets is reduced when the sheets are fed is the same as that of the first embodiment. In particular, change in paper feeding pressure can be reduced by obtaining the initial total weight W of the sheets and the initial height t of stacked sheets on the basis of the detection result of the weight detection sensor 68, calculating Δt from equations (8), (9) and (10) by the controller and then adjusting pressure force each time the sheet height of stacked sheets is reduced by Δt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-273897 filed Dec. 8, 2010, which is hereby incorporated by reference herein in its entirety.

What is claimed is:

1. A sheet feeding device to feed a sheet, the sheet feeding device comprising:

a tray configured to carry a stack of sheets, including the sheet, and be raised and lowered;

a sheet feeder configured to send out the sheet stacked on the tray;

a pressurizing unit configured to urge the tray to pressurize the sheet stacked on the tray against the sheet feeder;

a height detection unit configured to detect height of sheets stacked on the tray;

a weight detection unit configured to detect weight of the stacked sheet; and a control unit configured to adjust pressure force of the pressurizing unit in accordance with change in height of sheets stacked on the tray on a basis of weight per unit height of the sheets calculated in a following manner: weight per unit height of the stacked sheets is calculated on a basis of an initial total weight of the sheets stacked on the tray detected by the weight detection unit before a feeding operation is started and on a basis of the initial height of sheets stacked on the tray detected by the height detection unit before a sheet feeding operation is started.

2. The sheet feeding device according to claim 1, wherein the weight detection unit includes a balanced state detection unit and a pressure force detection unit, wherein the balanced state detection unit is configured to detect a state in which pressure force of the pressurizing unit and the initial total weight of the sheets are balanced, wherein the pressure force detection unit is configured to detect pressure force, and wherein, in response to the balanced state detection unit detecting the balanced state, the control unit lets the pressure force detection unit detect pressure force and thereby calculates the initial total weight of the sheets stacked on the tray.

3. The sheet feeding device according to claim 2, wherein the balanced state detection unit detects the state in which pressure force and the initial total weight of the sheets are balanced, and wherein paper feeding pressure between the sheet and the sheet feeder is determined by applying predetermined amount of pressure force in the balanced state before sheet feeding is started.

4. The sheet feeding device according to claim 2, wherein the balanced state detection unit outputs a detection signal in response to an upper surface of the sheet reaching predetermined height due to the pressurizing unit raising the tray and until the upper surface of the sheet stacked on the tray comes in contact with the sheet feeder.

5. The sheet feeding device according to claim 1, wherein the weight detection unit is a weight detection sensor configured to directly detect the initial total weight of the sheets stacked on the tray before sheet feeding is started.

6. The sheet feeding device according to claim 1, wherein an amount of change in paper feeding pressure between a sheet and the sheet feeder is calculated in response to height of stacked sheets being decreased by a certain amount as a result of sheets fed in accordance with the calculated weight per unit height of the sheets, and wherein the pressurizing unit adjusts pressure force, such that pressure force, corresponding to an amount of decrease in paper feeding pressure, increases.

7. The sheet feeding device according to claim 1, wherein the pressurizing unit includes a spring configured to apply force in a direction in which the tray is raised, and a motor configured to pull the spring, wherein pressure force increases as an amount of stretch of the spring increases.

8. The sheet feeding device according to claim 1, wherein the height detection unit includes a rotation angle detection unit provided at the pressurizing unit to detect a rotation angle of a pressurizer arm as the pressurizer arm rotates and raises the tray.

9. An image forming apparatus, comprising:

an image forming unit configured to form an image on a sheet fed from a sheet feeding device; and the sheet feeding device, wherein the sheet feeding device includes:

a tray configured to carry a stack of sheets, including the sheet, and be raised and lowered;

a sheet feeder configured to send out the sheet stacked on the tray;

a pressurizing unit configured to urge the tray to pressurize the sheet stacked on the tray against the sheet feeder;

a height detection unit configured to detect height of sheets stacked on the tray;

a weight detection unit configured to detect weight of the stacked sheet; and a control unit configured to adjust pressure force of the pressurizing unit in accordance with change in height of sheets stacked on the tray on a basis of weight per unit height of the sheets calculated in a following manner: weight per unit height of the stacked sheets is calculated on a basis of an initial total weight of the sheets stacked on the tray detected by the weight detection unit before a feeding operation is started and on a basis of the initial height of sheets stacked on the tray detected by the height detection unit before a sheet feeding operation is started.

10. The image forming apparatus according to claim 9, wherein the weight detection unit includes a balanced state detection unit and a pressure force detection unit, wherein the balanced state detection unit is configured to detect a state in which pressure force of the pressurizing unit and the initial total weight of the sheets are balanced, wherein the pressure force detection unit is configured to detect pressure force, and wherein, in response to the balanced state detection unit detecting the balanced state, the control unit lets the pressure force detection unit detect pressure force and thereby calculates the initial total weight of the sheets stacked on the tray.

11. The image forming apparatus according to claim 10, wherein the balanced state detection unit detects the state in which pressure force and the initial total weight of the sheets are balanced, and wherein paper feeding pressure between the sheet and the sheet feeder is determined by applying predetermined amount of pressure force in the balanced state before sheet feeding is started.

12. The image forming apparatus according to claim 10, wherein the balanced state detection unit outputs a detection signal in response to an upper surface of the sheet reaching predetermined height due to the pressurizing unit raising the tray and until the upper surface of the sheet stacked on the tray comes in contact with the sheet feeder.

13. The image forming apparatus according to claim 9, wherein the weight detection unit is a weight detection sensor configured to directly detect the initial total weight of the sheets stacked on the tray before sheet feeding is started.

14. The image forming apparatus according to claim 9, wherein an amount of change in paper feeding pressure between a sheet and the sheet feeder is calculated in response to height of stacked sheets being decreased by a certain amount as a result of sheets fed in accordance with the calculated weight per unit height of the sheets, and wherein the pressurizing unit adjusts pressure force, such that pressure force, corresponding to an amount of decrease in paper feeding pressure, increases.

15. The image forming apparatus according to claim 9, wherein the pressurizing unit includes a spring configured to apply force in a direction in which the tray is raised, and a motor configured to pull the spring, wherein pressure force increases as an amount of stretch of the spring increases.

16. The image forming apparatus according to claim 9, wherein the height detection unit includes a rotation angle detection unit provided at the pressurizing unit to detect a rotation angle of a pressurizer arm as the pressurizer arm rotates and raises the tray.

* * * * *